US011185473B1

(12) United States Patent
Warner

(10) Patent No.: US 11,185,473 B1
(45) Date of Patent: Nov. 30, 2021

(54) TABLET COUNTING APPARATUS AND METHOD HAVING A TIME OUT FEATURE

(71) Applicant: MCKESSON CORPORATION, Irving, TX (US)

(72) Inventor: Jason Warner, Downingtown, PA (US)

(73) Assignee: McKESSON CORPORATION, Irving, TX (US)

( * ) Notice: Subject to any disclaimer, the term of this patent is extended or adjusted under 35 U.S.C. 154(b) by 84 days.

(21) Appl. No.: 16/835,560

(22) Filed: Mar. 31, 2020

(51) Int. Cl.

| | |
|---|---|
| ***A61J 7/02*** | (2006.01) |
| ***A61J 7/04*** | (2006.01) |
| ***B65D 83/04*** | (2006.01) |
| ***A61J 7/00*** | (2006.01) |

(52) U.S. Cl.
CPC ..... *A61J 7/02* (2013.01); *A61J 7/0084* (2013.01); *A61J 7/0445* (2015.05); *B65D 83/0409* (2013.01); *A61J 2200/70* (2013.01)

(58) Field of Classification Search
CPC ..... A61J 7/0481; A61J 1/03; A61J 7/0472; A61J 7/02; A61J 7/0084; G04C 23/40; G04G 11/00; G04G 13/026; B65B 5/103; B65B 37/08; B65B 57/14; B65B 57/20; Y10S 53/90; B65D 83/0409
USPC ..... 53/54–55
See application file for complete search history.

(56) References Cited

U.S. PATENT DOCUMENTS

2009/0218363 A1* 9/2009 Terzini ..... B65B 5/103 221/4

OTHER PUBLICATIONS

IMA North America, "EKC Counter, Item 3410", Manual, dated at least as early as Dec. 11, 2019, 38 pages.

(Continued)

*Primary Examiner* — Gene O Crawford
*Assistant Examiner* — Ayodeji T Ojofeitimi
(74) *Attorney, Agent, or Firm* — Ballard Spahr LLP

(57) ABSTRACT

A tablet counting apparatus and method and an associated control device are provided to ensure that the same type of tablets is transferred from a canister to a counter following the replacement of one canister with another. In addition to the counter and the replaceable canister, the tablet counting apparatus includes a gate that moves between closed and open positions. The tablet counting apparatus further includes a controller configured, following installation of the canister, to provide an authorization command to authorize the gate to be opened by being moved from the closed position to the open position. The tablet counting apparatus additionally includes a timer responsive to the authorization command. The controller is also configured to be responsive to the timer so as no longer provide the authorization command following expiration of the timer to prevent the gate from being subsequently opened if the gate has not already been opened.

20 Claims, 3 Drawing Sheets

(56) References Cited

OTHER PUBLICATIONS

IMA North America, "EKC Automated Pharmacy Counters", Product Sheet, Internet Archive Wayback Machine, Aug. 8, 2018 to Jun. 9, 2019, retrieved from https://web.archive.org/web/20180808162054/http://ekccounting.com/, 1 page.
IMA Sustain Ability, "EKC Automated Pharmacy Counter Spec", retrieved from https://ima.it/pharma/machine/ekc-automated-pharmacy-counters/ on Jun. 24, 2020, 1 page.
Innovation, "Innovation Partners with IMA North America to Bring High Volume Dispensing Technology to Central Fill and Mail Order Pharmacies", Press Release, Aug. 2, 2016, retrieved from https://innovat.com/innovation-partners-with-ima-north-america-to-bring-high-volume-dispensing-technology-to-central-fill-and-mail-order-pharmacies/ on Jun. 25, 2020, 2 pages.

* cited by examiner

TABLET COUNTING APPARATUS AND METHOD HAVING A TIME OUT FEATURE

TECHNOLOGICAL FIELD

An example embodiment of the present disclosure relates generally to a tablet counting apparatus and method and an associated control device and, more particularly, to a tablet counting apparatus and method and an associated control device having a time out feature.

BACKGROUND

A tablet counting apparatus automatically counts quantities of tablets, such as pills, of various medication. A tablet counting apparatus may be utilized in a variety of applications including the transfer of a predefined number of tablets from a canister that contains a bulk quantity of the tablets into a container having a predefined number of tablets. The container may then be provided to a pharmacy, for example, which has ordered the predefined number of tablets from which to fill prescriptions for patients.

A tablet counting apparatus includes a slide positioned between the bulk canister and the counter. The slide is movable between an open position that permits tablets to be transferred from the bulk canister to the counter and a closed position that prevents tablets from being transferred from the bulk canister to the counter. During tablet counting operations, the slide is in the open position. Once a first bulk canister has been emptied and the tablets have been counted and transferred to one or more containers, the first bulk canister must be replaced with a second bulk canister that is filled with additional tablets to be counted. The tablets contained by the second bulk canister should be the same type of tablets in terms of the medication and the dosage as the tablets that have been transferred from the first bulk canister so as to avoid mixing two different types of tablets within the counter and, in turn, in the same container.

Once the tablets have been transferred from the first bulk canister such that the first bulk canister is empty, the slide of the tablet counting apparatus may be moved to a closed position and the first bulk canister may be removed from the tablet counting apparatus. The second bulk canister may then be installed. To avoid mixing tablets of different medications or different dosages, the tablet counting apparatus confirms that the tablets contained in the second canister are the same type of tablets as those previously transferred from the first canister. In this regard, each canister can include identification that can be sensed by the tablet counting apparatus. Based upon the identification of the canister, the type of tablets contained by the canister may, in turn, be determined. Thus, upon insertion of the second canister, the tablet counting apparatus senses the identification associated with the second canister and determines the type of tablets contained by the second canister. In an instance in which the second canister is determined to contain a different type of tablets than the first canister, the tablet counting apparatus may prevent transferring of the tablets from the second canister to the counter and may therefore avoid mixing different types of tablets within the counter. For example, the slide of the tablet counting apparatus may remain in the closed position to block the opening from the canister to the counter. However, in an instance in which the identification associated with the second canister indicates that the second canister contains the same type of tablets as the first canister, the slide is unlocked and an operator may move the slide to the open position so as to no longer block the opening, thereby permitting tablets to be transferred from the second canister to the counter. The tablet counting apparatus may then recommence counting of the tablets as the tablets are transferred into a container intended to contain a predefined number of the tablets.

Notwithstanding the verification process in which the second canister is confirmed to contain the same type of tablets as the first canister, the tablet counting apparatus is still at risk of transferring a different type of tablets to the counter than the tablets previously provided by the first canister. In this regard, after the tablet counting apparatus has determined that the second canister that has been installed contains the same type of tablets as the first container and the slide is unlocked, the second canister may be removed and replaced with a third canister containing a different type of tablets prior to moving the slide to the open position. Since the slide was unlocked following the verification of the second canister, the identification of the third canister is not sensed and, instead, the slide remains unlocked. Thus, after installing the third canister containing the incorrect type of tablets, the operator may move the slide to the open position so as to permit a different type of tablet to be transferred from the third canister to a reserve hopper and potentially mixing with the tablets from the first canister. Although the identification of the third canister may be detected in some instances upon recommencing counting operations, the different type of tablets from the third canister will have already been transferred to the reserve hopper so as to create the risk that different types of tablets will be counted by the counter and transferred, in turn, to the container.

This potential scenario in which different types of tablets may be transferred to a counter is undesirable. In this regard, a tablet counting apparatus is intended to transfer a predefined number of tablets to a container, such as for sale and delivery to a pharmacy or the like. The pharmacy expects that each tablet of a container that it receives is the same type of tablet. Thus, for purposes of inventory control and to ensure that the prescriptions of patients are filled with tablets of the correct medication and the correct dosage, the potential mixing of different types of tablets in a container following the counting process cuts against a primary purpose of the tablet counting apparatus.

BRIEF SUMMARY

A tablet counting apparatus and method and an associated control device are provided to ensure that the same type of tablets is transferred from a canister to the counter following the replacement of a first canister with a second canister. In this regard, the tablet counting apparatus and method and associated control device temporally limit the period during which a gate between the canister and the counter is unlocked and able to be moved to an open position after having verified that the second canister contains the same type of tablet as the first canister. Thus, the risk of the second canister being replaced by a third canister with a different type of tablets while the gate remains unlocked and able to be moved to the open position is greatly reduced or eliminated.

A tablet counting apparatus is provided that includes a counter configured to count a plurality of tablets and a replaceable canister containing a plurality of tablets. The canister is configured to be installed such that the tablets are controllably delivered to the counter. The tablet counting apparatus also includes a gate configured to move between a closed position that prevents tablets from the canister from being delivered to the counter and an open position that permits tablets from the canister to be delivered to the counter. The tablet counting apparatus further includes a controller configured, following installation of the canister, to provide an authorization command to authorize the gate to be opened by being moved from the closed position to the open position to permit tablets to be delivered to the counter. The tablet counting apparatus additionally includes a timer responsive to the authorization command. The controller is also configured to be responsive to the timer so as to no longer provide the authorization command following expiration of the timer to prevent the gate from being subsequently opened in an instance in which the gate has not already been opened.

The replaceable canister of an example embodiment includes identification. In this example embodiment, the tablet counting apparatus also includes a sensor configured to recognize the identification, and the controller is responsive to the sensor and is configured to provide the authorization command only in an instance in which the canister is determined based on the identification to be authorized to transfer tablets to the counter or to contain tablets that are authorized to be counted. The tablet counting apparatus may also include an input device configured to provide an input following expiration of the timer that causes the identification of the canister to be recognized by the sensor and provided to the controller. The controller of this example embodiment is configured to again issue the authorization command following expiration of the timer in an instance in which the canister is determined based on the identification to be authorized to transfer tablets to the counter or to contain tablets that are authorized to be counted.

The timer of an example embodiment is configured to issue a time out signal after a predefined time period has elapsed following provision of the authorization command. The predefined time period may be no greater than 5 seconds in some embodiments and no greater than 2 seconds in other embodiments. The gate of an example embodiment includes a slide with the slide being configured to slide from the closed position to the open position in response to the authorization command, but is prevented from being slid from the closed position to the open position in an instance in which the authorization command is no longer provided following expiration of the timer.

In another example embodiment, a control device of a tablet counting apparatus includes a controller configured, following installation of a canister, to provide an authorization command to authorize a gate to be opened by being moved from the closed position in which tablets are unable to be delivered to a counter to the open position to permit tablets to be delivered to the counter. The control device also includes a timer responsive to the authorization command. The controller of this example embodiment is also configured to be responsive to the timer so as no longer provide the authorization command following expiration of the timer to prevent the gate from being subsequently opened in an instance in which the gate has not already been opened.

The controller of an example embodiment is configured, based on identification carried by the canister, to determine whether the canister is authorized to transfer tablets to the counter or to contain tablets that are authorized to be counted. The controller of this example embodiment is configured to provide the authorization command only in an instance in which the canister is determined to be authorized to transfer tablets to the counter or to contain tablets that are authorized to be counted. In this example embodiment, the controller may be configured to again issue the authorization command following expiration of the timer in an instance in which the canister is again determined, in response to an input and based on the identification, to be authorized to transfer tablets to the counter or to contain tablets that are authorized to be counted. The timer of an example embodiment is configured to issue a time out signal after a predefined time period has elapsed following provision of the authorization command. The predefined time period may be no greater than 5 seconds in some embodiments and no greater than 2 seconds in other embodiments.

In a further example embodiment, a method is provided for replenishing a tablet counting apparatus. The method includes installing a replaceable canister containing a plurality of tablets while a gate is in a closed position that prevents tablets from the canister from being delivered to a counter. Following installation of the canister, the method provides an authorization command to authorize the gate to be opened by being moved from the closed position to an open position in which tablets are permitted to be delivered to the counter. The method also includes initiating a timer in response to the authorization command and, in response to expiration of the timer, ceasing provision of the authorization command to prevent the gate from being subsequently opened in an instance in which the gate has not already been opened.

The method of an example embodiment also includes recognizing identification carried by the replaceable canister and, based on the identification, determining whether the replaceable canister is authorized to transfer tablets to the counter or to contain tablets that are authorized to be counted. In this example embodiment, the provision of the authorization command is dependent upon a determination that the replaceable canister is authorized to transfer tablets to the counter or to contain tablets that are authorized to be counted. The method of this example embodiment may also include receiving an input following expiration of the timer, cause, in response to the input, the identification of the canister to again be recognized and providing the authorization command again following expiration of the timer in an instance in which the canister is determined based on the identification to be authorized to transfer tablets to the counter or to contain tablets that are authorized to be counted.

The method of an example embodiment also includes issuing a time out signal after a predefined time period has elapsed following provision of the authorization command. The predefined time period may be no greater than 5 seconds in some embodiments and no greater than 2 seconds in other embodiments. In an embodiment in which the gate includes a slide, the method of an example embodiment also includes permitting the slide to be slid from the closed position to the open position in response to the authorization command and preventing the slide from being slid from the closed position to the open position in an instance in which the authorization command is no longer provided following expiration of the timer.

BRIEF DESCRIPTION OF THE DRAWINGS

Figure 1:
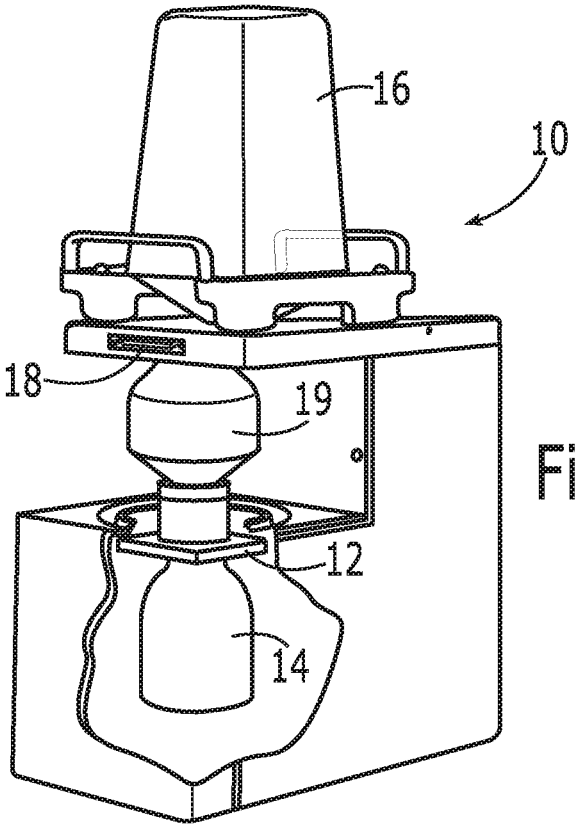
Figure 2:
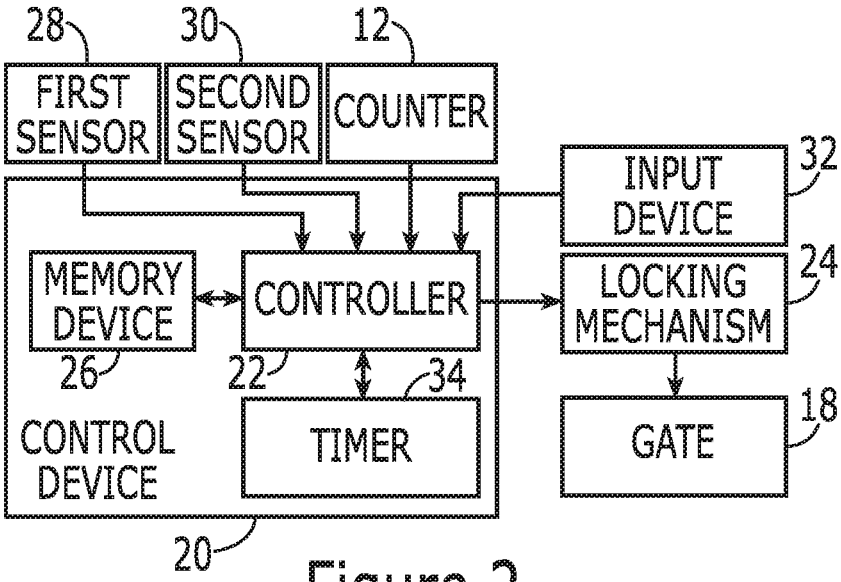
Figure 3:
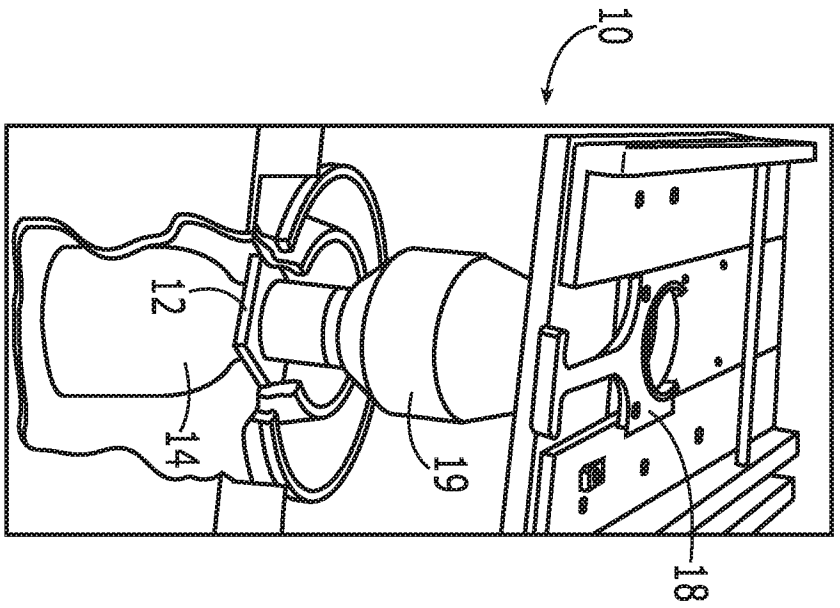
Figure 4:
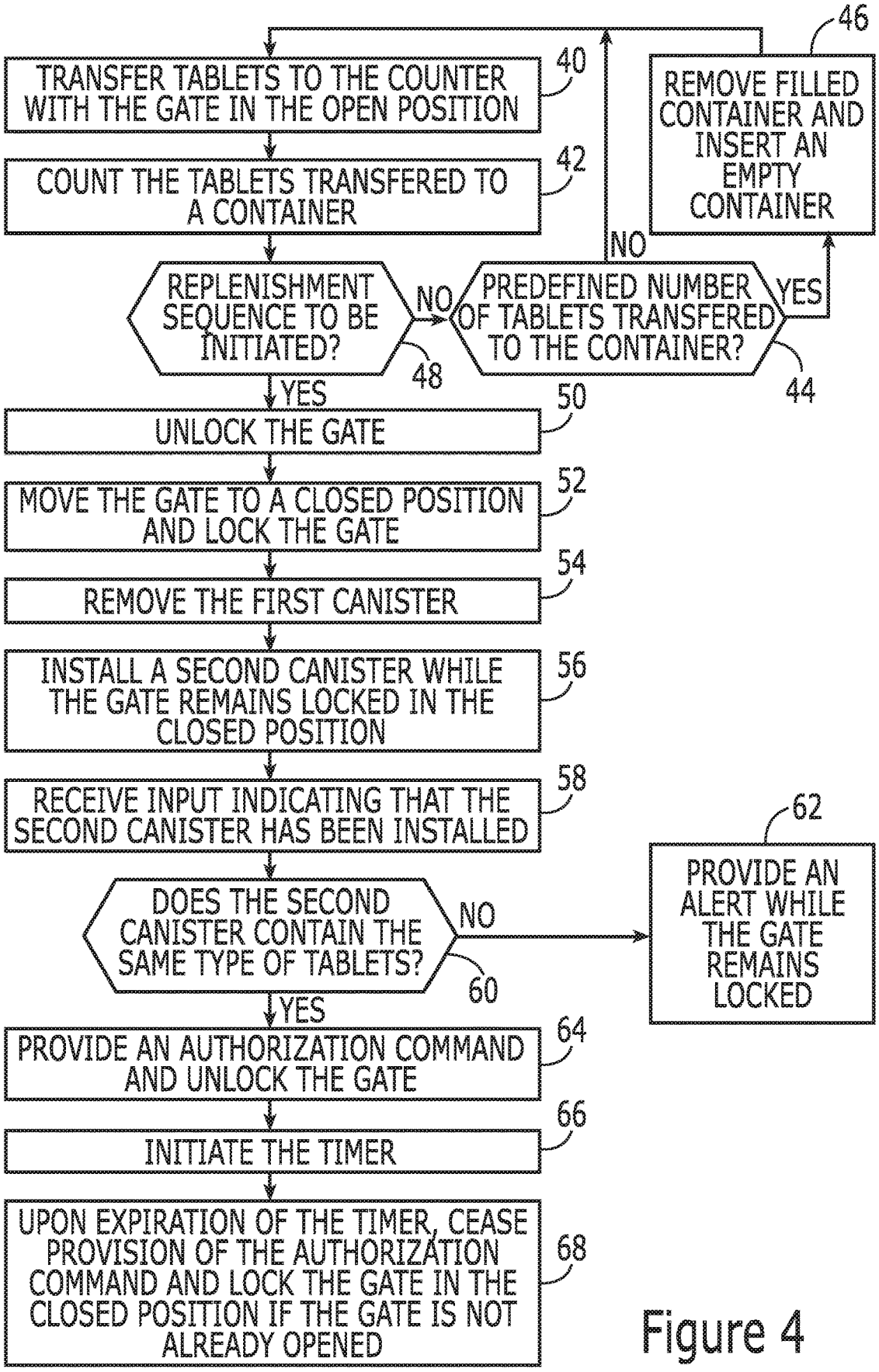

Having thus described certain embodiments of the invention in general terms, reference will now be made to the accompanying drawings, which are not necessarily drawn to scale, and wherein:

FIG. 1 is a perspective view of a tablet counting apparatus that may incorporate a control device of an example embodiment and in which a portion of the housing has been removed for purposes of depicting a counter and container that collects the tablets after the counting process;

FIG. 2 is a block diagram of a tablet counting apparatus including a control device in accordance with an example embodiment;

FIG. 3 is a perspective view of a portion of a tablet counting apparatus in which the canister has been removed so as to illustrate a gate that is movable between closed and open positions and in which a portion of the housing has been removed for purposes of depicting a counter and container that collects the tablets after the counting process; and FIG. 4 is a flowchart illustrating operations performed, such as by the tablet counting apparatus, in accordance with an example embodiment.

DETAILED DESCRIPTION

Some embodiments of the present invention will now be described more fully hereinafter with reference to the accompanying drawings, in which some, but not all embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout.

A tablet counting apparatus and method and an associated control device are provided in accordance with an example embodiment. As described below, the tablet counting apparatus and method are configured to control the period of time during which a gate that separates a canister containing bulk quantities of the tablets to be counted from a counter remains unlocked and able to be moved from a closed position to a open position following verification of the type of tablet that is contained by the canister. Thus, the tablet counting apparatus and method and the associated control device reduce, if not eliminate, the risk associated with replacement of the canister following the verification of the type of tablets contained by the canister with a different canister containing a different type of tablet and, consequently, reduces, if not eliminates, the risk associated with mixing different types of tablets within the counter and potentially within a container to which the counter transfer the tablets.

Referring now to FIGS. 1 and 2, a tablet counting apparatus 10 is depicted in a perspective view and in a block diagram, respectively. The tablet counting apparatus includes a counter 12 configured to receive a plurality of tablets, to singulate the tablets and to count the tablets as the tablets are transferred by the counter to a container 14. Thus, the counter facilitates the transfer of a predefined number of the same type of tablets, that is, tablets of the same medication and for the same dosage, to the container. Once filled, the container may be placed in inventory or shipped to a customer, such as a pharmacy for filling prescriptions.

As shown in FIGS. 1 and 2, the tablet counting apparatus 10 also includes a canister 16. The canister includes a plurality of tablets. The tablets may be of any of a variety of different medications and any of a variety of different dosages, but each of the tablets contained in a respective canister is the same type of tablet, that is, the same medication and the same dosage. The canisters are replaceable such that once all of the tablets previously contained by the canister have been transferred, the empty canister may be removed from the tablet counting apparatus and a different canister that is filled with tablets may be inserted into the tablet counting apparatus.

To control the provision of tablets to the counter 12, the tablet counting apparatus 10 additionally includes a gate 18 that is configured to controllably move between a closed position and an open position. In the open position, the opening between the canister 16 and the counter is exposed such that tablets may be transferred from the canister to the counter. In the closed position, however, the gate blocks the opening between the canister and the counter and prevents tablets from being transferred from the canister to the counter.

Although the gate 18 may be configured in various manners, the gate of an example embodiment is a slide, one example of which is depicted in FIG. 3. Although the slide of other example embodiments may be controllably moved between the closed and open positions in an automated manner, the slide of the embodiment that is illustrated and described herein is manually actuated such that an operator may move the slide between the closed and the open positions. In FIG. 3, the slide is depicted to be in the open position such that the opening between the canister 16 (which has been removed for purposes of illustrating the slide) and the counter 12 is exposed to permit the transfer of tablets from the canister to the counter. In the closed position, the slide is repositioned so as to cover or otherwise block the opening and to prevent tablets from being transferred from the canister to the counter. Although the slide may be configured to move in various directions between the open and closed positions, the slide of the illustrated embodiment is configured to be slid forwardly and rearwardly relative to the remainder of the tablet counting apparatus 10 in order to alternately move between the open and closed positions.

Although the tablet counting apparatus 10 may be configured to transfer the tablets directly to the counter 12, the tablet counting apparatus of the illustrated embodiment includes a reserve hopper 19. The reserve hopper is positioned between canister 16 and the gate 18 on one side and the counter on the other side. As such, the canister transfers the tablets to the counter by first transferring the tablets to the reserve hopper with the reserve hopper then transferring the tablets to the counter. The reserve hopper generally stores a smaller quantity of tablets, such as a substantially smaller quantity of tablets, than the canister. As used herein, reference to the canister transferring tablets to the counter includes not only those embodiments without a reserve hopper in which the canister transfers tablets directly to the counter, but also embodiments that include a reserve hopper such that the canister transfers tablets to the reserve hopper and the reserve hopper then transfers the tablets to the counter.

The tablet counting apparatus 10 also includes a control device 20. As shown in FIG. 2, the control device includes a controller 22 configured to selectively lock and unlock the gate 18. The tablet counting apparatus therefore also includes a locking mechanism 24, responsive to the controller, configured to selectively lock the gate in order to prevent the gate from being moved between the open and closed positions. The tablet counting apparatus may include a variety of different types of locking mechanisms, but, in one embodiment, includes a solenoid. The solenoid is responsive to the controller so as to alternately lock and unlock the gate based upon commands from the controller.

The controller 22 may be embodied in a number of different ways. For example, the controller may be embodied as various processing means such as one or more of a microprocessor or other processing element, a coprocessor or various other computing or processing devices including integrated circuits such as, for example, an ASIC (application specific integrated circuit), an FPGA (field programmable gate array), or the like. In an example embodiment, the controller may be configured to execute instructions stored in a memory device 26 or otherwise accessible to the controller. As such, whether configured by hardware or by a combination of hardware and software, the controller may represent an entity (e.g., physically embodied in circuitry—in the form of control circuitry) specifically configured to perform operations according to embodiments of the present invention while configured accordingly. Thus, for example, when the controller is embodied as an ASIC, FPGA or the like, the controller may be specifically configured hardware for conducting the operations described herein. Alternatively, as another example, when the controller is embodied as an executor of software instructions, the instructions may specifically configure the controller to perform the operations described herein.

The tablet counting apparatus 10 also includes a first sensor 28 that is configured to recognize the canisters 16 that are installed on the tablet counting apparatus. In this regard, the canisters include identification. The identification may identify the type of tablet that is contained by the canister, such as the medication and the dosage of the tablets. Alternatively, the identification may identify the canister which then permits the type of tablets contained by the canister, such as the medication and the dosage of the tablet, to be identified.

In an instance in which the identification identifies the type of tablet, the controller 22 may be configured to access memory device 26 or another database which may include a listing of the identifications and the type of tablets associated with each identification. Alternatively, in the embodiment in which the identification identifies the canister 16, the memory device or other database may include a listing of the identifications and the respective canister associated therewith as well as another listing associating the canisters and the respective types of tablets contained therein.

The identification may be provided in various manners. In one embodiment, the identification is provided by an iButton or a radio frequency identification begin (RFID) tag carried by the canister 16 with the first sensor 28 configured to read the iButton or the RFID tag and to recognize the identification. The first sensor is in communication with the controller 22 so as to provide the controller with the identification associated with the canister that has been installed such that the controller may, in turn, determine the types of tablet contained by the canister that has been installed in the manner described above.

Referring now to FIG. 4, the operations performed by a tablet counting apparatus 10 in accordance with an example embodiment are depicted. Beginning with a canister 16 mounted upon the tablet counting apparatus, the gate 18 is in the open position and tablets are transferred from the canister to the counter 12. See block 40. The counter, in turn, counts the tablets and transfers the tablets to a container 14. See block 42. The counter is in communication with the controller 22 which monitors the number of tablets transferred from the counter to the container and ceases counting operations once a predefined number of tablets have been transferred to the container. See block 44. The container may then be removed and a different, empty container may reinserted. See block 46. The container that has been removed is filled with a predefined number of tablets and may be provided, for example, to a pharmacy for use in filling patients' prescriptions. Once the empty container has been inserted, the counting operations can resume as described above.

Prior to determining whether the container 14 has been filled, a determination may be made as to whether a replenishment sequence is to be initiated with the replenishment sequence being initiated in an instance in which the canister 16 that provides the bulk supply of tablets is empty or it is otherwise determined to be desirable to replenish the supply of tablets. See block 48. A replenishment sequence may be initiated by the controller 22 and/or by an operator of the tablet counting apparatus 10. In an embodiment in which the controller triggers the replenishment sequence, the tablet counting apparatus may include a second sensor 30 configured to monitor the delivery of tablets from the canister to the counter 12. The second sensor is also in communication with the controller. In an instance in which the canister is to be transferring tablets to the counter, but no additional tablets are being provided, the controller is configured to determine, based upon the information provided by the second sensor as to the lack of tablets, that the canister is empty and needs to be replenished. Alternatively, an operator who oversees the tablet counting apparatus may note that the canister has emptied its contents into the counter. In this instance, the operator may provide an input, such as via an input device 32, e.g., a keyboard, a touch screen, a discrete button or the like, to the controller. The controller of this example embodiment is configured to be responsive to the input device and to interpret the input that is provided as an indication that the replenishment sequence is to commence.

Once the replenishment sequence is commenced, the controller 22 directs that the gate 18 be unlocked, such as by directing the locking mechanism 24 to unlock the gate, e.g., by removing power from the solenoid that has caused the gate to be locked in position. See block 50. The gate may then be moved, such as by an operator, from the open position to the closed position with the gate then being locked in the closed position by the locking mechanism. See block 52. The canister may then be removed from the tablet counting apparatus 10, such as by the operator. See block 54. After having obtained a second canister filled with tablets, the second canister may be installed, such as by the operator, while the gate remains locked in the closed position, thereby preventing the tablets from being delivered from the second canister to the counter 12. See block 56. Once installed, an input signal may be received by the controller 22, such as from an operator via the input device 32, indicating that the second canister has been installed. See block 58. As described above, the controller is responsive to the input and is configured to recognize the input as being indicative of the completion of the installation of the second canister. The controller is then configured to identify the second canister and/or the tablets contained by the second canister so as to verify that the second canister contains the same type of tablets as the prior canister. See block 60. In one embodiment, the controller issues a signal prompting the first sensor 28 to read the identification of the second canister and to provide information regarding the identification of the second canister to the controller. In an alternative embodiment, the first sensor is configured to automatically recognize the identification of the second canister following installation of this second canister. In either embodiment, the controller is provided with information regarding the identification of the second canister and based upon the information regarding the identification the second canister is configured to determine the type of tablets, such as the medication and the dosage of the tablets, contained by the second canister in the manner described above.

In an instance in which the controller 22 determines that the second canister 16 does not contain the same type of tablets as the prior canister, the controller is configured to maintain the gate 18 locked in the closed position and, in some embodiments, to provide an alert to the operator as to the installation of a canister containing a different type of tablets. See block 62. However, in an instance in which the controller determines that the second canister contains the same type of tablets as the prior canister, an authorization command is provided, such as by the controller, to authorize the gate to be opened by being move from the closed position to the open position in which tablets are subsequently permitted to be delivered to the counter 12. See block 64. In this regard, the authorization command issued by the controller may cause the locking mechanism 24, such as the solenoid, to be deactivated to permit the gate to be moved from the closed position to the open position. In an example embodiment, the operator may then move the slide from the closed position to the open position. If the repositioning of the slide is halted in an intermediate position between open and closed positions, the counter of one embodiment will not be active as the counter is triggered to commence counting operations by the slide being in the fully open position.

In an example embodiment, the control device 20 also includes a timer 34 that is initiated, such as by the controller 22, in response to the authorization command. See block 66. In one embodiment, the controller and the timer may be embodied as a single entity, while in other embodiments, the controller and the timer may be separate entities in communication with one another. In this example embodiment, the timer is configured to expire following a predefined period of time after being initiated and, in response to expiration, to provide a time out signal to the controller. In response to expiration of the timer, the controller causes provision of the authorization command to be ceased so as to prevent the gate 18 from being subsequently opened in instance in which the gate is not already been opened. See block 68. For example, upon expiration of the timer and in response to the cessation of the authorization command, the locking mechanism 24, such as the solenoid, may be activated so as to lock the gate in the closed position if the gate has not already been moved to the open position.

As such, during the replenishment process and following the determination that the second canister 16 contains the same type of tablets as the first canister, the gate 18 is unlocked and is able to be moved to the open position. In accordance with this example embodiment, however, the gate is only able to be moved to the open position for a predefined period of time following the verification that the second canister contains the proper type of tablets. If the gate is moved from the closed position to the open position within the predefined period of time, the counting process can recommence as described above with tablets being provided by the second canister to the counter 12 for being counted and transferred to a container 14 with the gate remaining in the open position. However, in an instance in which the gate is not moved from the closed position to the open position within the predefined period of time, such as in an instance in which the operator of a manually actuated slide does not move the slide from the closed position to the open position within the predefined period of time, the controller causes the gate to again be locked in the closed position.

The predefined period of time may be selected so as to reduce the risk or eliminate the risk of the second canister 12 being removed after having verified that the second canister contains the proper type of tablets and unlocking the gate 18 so as to replace the second canister with a third canister containing a different type of tablets while the gate remains unlocked and able to be moved to the open position. For example, the predefined period of time may be a period of time no greater than 5 seconds, no greater than 2 seconds or the like.

In an instance in which the gate 18 is re-locked in the closed position following the expiration of the predefined period of time, the replenishment sequence may simply be restarted, such as by the controller 22, based upon input provided by the operator or the like, by again recognizing the identification of the canister 12 that is currently installed and, in an instance in which the canister that is currently installed is determined to include the desired type of tablets, such as the same type of tablets as the prior canister, providing the authorization command so as to cause the gate to again be unlocked, thereby permitting the gate to be moved from the closed position to the open position within the predefined period of time. Thus, the tablet counting apparatus 10 and method and the associated control device of an example embodiment allows replenishment of the canister 16, but does so in a controlled manner to reduce the risk of, if not prevent, the transfer of tablets from an unauthorized canister and the mixing of tablets within the counter 12.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A tablet counting apparatus comprising;

a counter configured to count a plurality of tablets;

a replaceable canister containing a plurality of tablets, wherein the canister is configured to be installed such that the tablets are controllably delivered to the counter;

a gate configured to move between a closed position that prevents tablets from the canister from being delivered to the counter and an open position that permits tablets from the canister to be delivered to the counter;

a controller configured, following installation of the canister, to provide an authorization command to authorize the gate to be opened by being moved from the closed position to the open position to permit tablets to be delivered to the counter; and a timer responsive to the authorization command, wherein the controller is also configured to be responsive to the timer so as no longer provide the authorization command following expiration of the timer to prevent the gate from being subsequently opened in an instance in which the gate has not already been opened.

2. A tablet counting apparatus according to claim 1 wherein the gate comprises a slide, and wherein the slide is configured to slide from the closed position to the open position in response to the authorization command but is prevented from being slid from the closed position to the open position in an instance in which the authorization command is no longer provided following expiration of the timer.

3. A tablet counting apparatus according to claim 1 wherein the timer is configured to issue a time out signal after a predefined time period has elapsed following provision of the authorization command.

4. A tablet counting apparatus according to claim 1 wherein the replaceable canister comprises identification, wherein the tablet counting apparatus further comprises a sensor configured to recognize the identification, and wherein the controller is responsive to the sensor and is configured to provide the authorization command only in an instance in which the canister is determined based on the identification to be authorized to transfer tablets to the counter or to contain tablets that are authorized to be counted.

5. A tablet counting apparatus according to claim 4 further comprises an input device configured to provide an input following expiration of the timer that causes the identification of the canister to be recognized by the sensor and provided to the controller, wherein the controller is configured to again issue the authorization command following expiration of the timer in an instance in which the canister is determined based on the identification to be authorized to transfer tablets to the counter or to contain tablets that are authorized to be counted.

6. A tablet counting apparatus according to claim 5 wherein the predefined time period is no greater than 5 seconds.

7. A tablet counting apparatus according to claim 5 wherein the predefined time period is no greater than 2 seconds.

8. A control device of a tablet counting apparatus comprising:

a controller configured, following installation of a canister, to provide an authorization command to authorize a gate to be opened by being moved from the closed position in which tablets are unable to be delivered to a counter to the open position to permit tablets to be delivered to the counter; and a timer responsive to the authorization command, wherein the controller is also configured to be responsive to the timer so as no longer provide the authorization command following expiration of the timer to prevent the gate from being subsequently opened in an instance in which the gate has not already been opened.

9. A control device according to claim 8 wherein the controller is configured, based on identification carried by the canister, to determine whether the canister is authorized to transfer tablets to the counter or to contain tablets that are authorized to be counted, and wherein the controller is configured to provide the authorization command only in an instance in which the canister is determined to be authorized to transfer tablets to the counter or to contain tablets that are authorized to be counted.

10. A control device according to claim 9 wherein the controller is configured to again issue the authorization command following expiration of the timer in an instance in which the canister is again determined, in response to an input and based on the identification, to be authorized to transfer tablets to the counter or to contain tablets that are authorized to be counted.

11. A control device according to claim 8 wherein the timer is configured to issue a time out signal after a predefined time period has elapsed following provision of the authorization command.

12. A control device according to claim 11 wherein the predefined time period is no greater than 5 seconds.

13. A control device according to claim 11 wherein the predefined time period is no greater than 2 seconds.

14. A method for replenishing a tablet counting apparatus, the method comprising:

installing a replaceable canister containing a plurality of tablets while a gate is in a closed position that prevents tablets from the canister from being delivered to a counter;

following installation of the canister, providing an authorization command to authorize the gate to be opened by being moved from the closed position to an open position in which tablets are permitted to be delivered to the counter;

initiating a timer in response to the authorization command; and in response to expiration of the timer, ceasing provision of the authorization command to prevent the gate from being subsequently opened in an instance in which the gate has not already been opened.

15. A method according to claim 14 wherein the gate comprises a slide, and wherein the method further comprises:

permitting the slide to be slid from the closed position to the open position in response to the authorization command; and preventing the slide from being slid from the closed position to the open position in an instance in which the authorization command is no longer provided following expiration of the timer.

16. A method according to claim 14 further comprising:

recognizing identification carried by the replaceable canister; and based on the identification, determining whether the replaceable canister is authorized to transfer tablets to the counter or to contain tablets that are authorized to be counted, wherein providing the authorization command is dependent upon a determination that the replaceable canister is authorized to transfer tablets to the counter or to contain tablets that are authorized to be counted.

17. A method according to claim 16 further comprising:

receiving an input following expiration of the timer;

in response to the input, causing the identification of the canister to again be recognized; and providing the authorization command again following expiration of the timer in an instance in which the canister is determined based on the identification to be authorized to transfer tablets to the counter or to contain tablets that are authorized to be counted.

18. A method according to claim 14 further comprising issuing a time out signal after a predefined time period has elapsed following provision of the authorization command.

19. A method according to claim 18 wherein the predefined time period is no greater than 5 seconds.

20. A method according to claim 18 wherein the predefined time period is no greater than 2 seconds.

* * * * *